US006014795A

United States Patent [19]

McMahon et al.

[11] Patent Number: 6,014,795

[45] Date of Patent: Jan. 18, 2000

[54] SLIDE ZIPPER ASSEMBLY

[75] Inventors: Michael J. McMahon, Palatine; Donald L. Van Erden, Wildwood; Robert G. Kobetsky, Chicago; Art Malin, Northbrook, all of Ill.; Zdenek Machacek, Nanuet, N.Y.

[73] Assignee: Illinois Tool Works Inc., Glenview, Ill.

[21] Appl. No.: 09/228,999

[22] Filed: Jan. 12, 1999

Related U.S. Application Data

[63] Continuation of application No. 09/093,111, Jun. 8, 1998.

[51] Int. Cl.[7] ..... A44B 19/00

[52] U.S. Cl. ..... 24/400; 24/399; 24/587

[58] Field of Search ..... 24/400, 399, 587, 24/576, 418, 436; 156/66; 383/63

[56] References Cited

U.S. PATENT DOCUMENTS

| | | | |
|---|---|---|---|
| 3,115,689 | 12/1963 | Jacobs | 24/399 |
| 3,122,807 | 3/1964 | Ausnit | 24/399 |
| 3,426,396 | 2/1969 | Laguerre | 24/399 |
| 5,007,143 | 4/1991 | Herrington | 24/400 |
| 5,131,121 | 7/1992 | Herrington, Jr. et al. | 24/400 |
| 5,442,838 | 8/1995 | Richardson et al. | 24/400 |
| 5,664,299 | 9/1997 | Porchia et al. | 24/400 |
| 5,729,876 | 3/1998 | Johnson | 24/587 |

*Primary Examiner*—Victor N. Sakran

*Attorney, Agent, or Firm*—Kane, Dalsimer, Sullivan and Levy, LLP

[57] ABSTRACT

A slide zipper assembly comprising an interlocked zipper and a slider is provided. The zipper has a first profile and a second profile. The profiles have arms ending in hooks that are engaged when the zipper is in a closed position. The slider is disposed for movement along the zipper. The slider has an opening end and a closing end. At the opening end the slider has a separator that extends downwardly to engage a profile arm to bend the same so that its hook disengages from the hook of the opposite profile.

3 Claims, 4 Drawing Sheets

SLIDE ZIPPER ASSEMBLY

CROSS REFERENCE TO RELATED APPLICATIONS

This is a continuation of U.S. patent application Ser. No. 09/093,111 filed on Jun. 8, 1998.

BACKGROUND OF THE INVENTION

1. Field of the Invention

The present invention relates to reclosable plastic bags of the type in which items may be stored. More particularly, the present invention relates to a slide zipper assembly for use with such plastic bags.

2. Description of the Prior Art

Slide zippers for use with plastic bags are well known in the reclosable fastener art. Examples of conventional slide zippers can be found in U.S. Pat. Nos. 5,007,143, 5,008,971, 5,131,121 and 5,664,299.

Typically, a slide zipper comprises a plastic zipper having two interlocking profiles and a slider for opening and closing the zipper. The slider straddles the zipper and has a separator at one end which is inserted between the profiles in order to force them apart, that is, the separator plows between the profiles forcing them to disengage. The other end of the slider is sufficiently narrow to be able to close the zipper.

Many prior art slider assemblies, however, have proven unsatisfactory. For example, some prior art slide zipper assemblies provide for inadequate interlocking of the zipper profiles, thereby resulting in leaking of the contents of the bag. Other prior art slide zipper assemblies do not function consistently, often failing to smoothly open and close the zipper. Yet other slide zipper assemblies are complex and often difficult and expensive to manufacture.

It is therefore the object of the present invention to provide a unique and novel slide zipper assembly for use with plastic bags which overcomes the problems associated with the prior art as discussed above.

SUMMARY OF THE INVENTION

The present invention solves the aforementioned problems by providing a novel slide zipper assembly comprising a slider and a zipper.

The zipper is comprised of two profiles, each having a pair of hooked arms. The hooks on the first profile are oriented outwardly with respect to each other and are adapted to engage the hooks of the second profile, which are oriented inwardly with respect to each other.

The slider straddles the zipper and is slidable therealong. As oriented on a bag having the zipper at the top, the slider consists of a top from which two arms depend. The slider bottom is defined by two inwardly directed tabs that extend toward each other from the free ends of the slider arms and which contact the profiles to hold the slider in place.

The slider has an opening end and a closing end. At the closing end the slider arm inner walls are sufficiently close to one another to press the two profiles into engagement when the slider is moved in the closing direction (i.e. opposite to the closing end). At the opening end of the slider there is a contoured separator blade which extends downwardly from the top of the slider and which is engageable with the top hooked arm of the first profile.

When the slider is moved in the opening direction, the separator blade disengages the top hooked arms of the profiles and a force component on the top hooked arm of the first profile urges the top of the first profile away from the second profile. At the opening end of the slider the inner walls of the slider arms are further apart than at the closing end such that the slider arms do not force the profiles into engagement. The opening end of the slider is also provided with a cavity to facilitate lateral movement of the first profile.

Additionally, the tab on the first slider arm engages the bottom of the first profile and lifts the same so that the bottom hooked arms of the two profiles also disengage. The combined actions of the separator blade and the tab on the first slider arm thus serve to first disengage the top hooked arm of the first profile from the top hooked arm of the second profile, then move the first profile away from the second profile, and then lift the bottom hooked arm of the first profile out of engagement with the bottom hooked arm of the second profile to thereby free the first profile from the second profile. Alternatively, the second slider arm could force the second profile downwardly out of engagement with the first profile.

The present invention will now be described in more complete detail with reference being made to the figures identified below wherein the same numerals represent identical elements.

DETAILED DESCRIPTION OF THE PREFERRED EMBODIMENT

Figure 1:
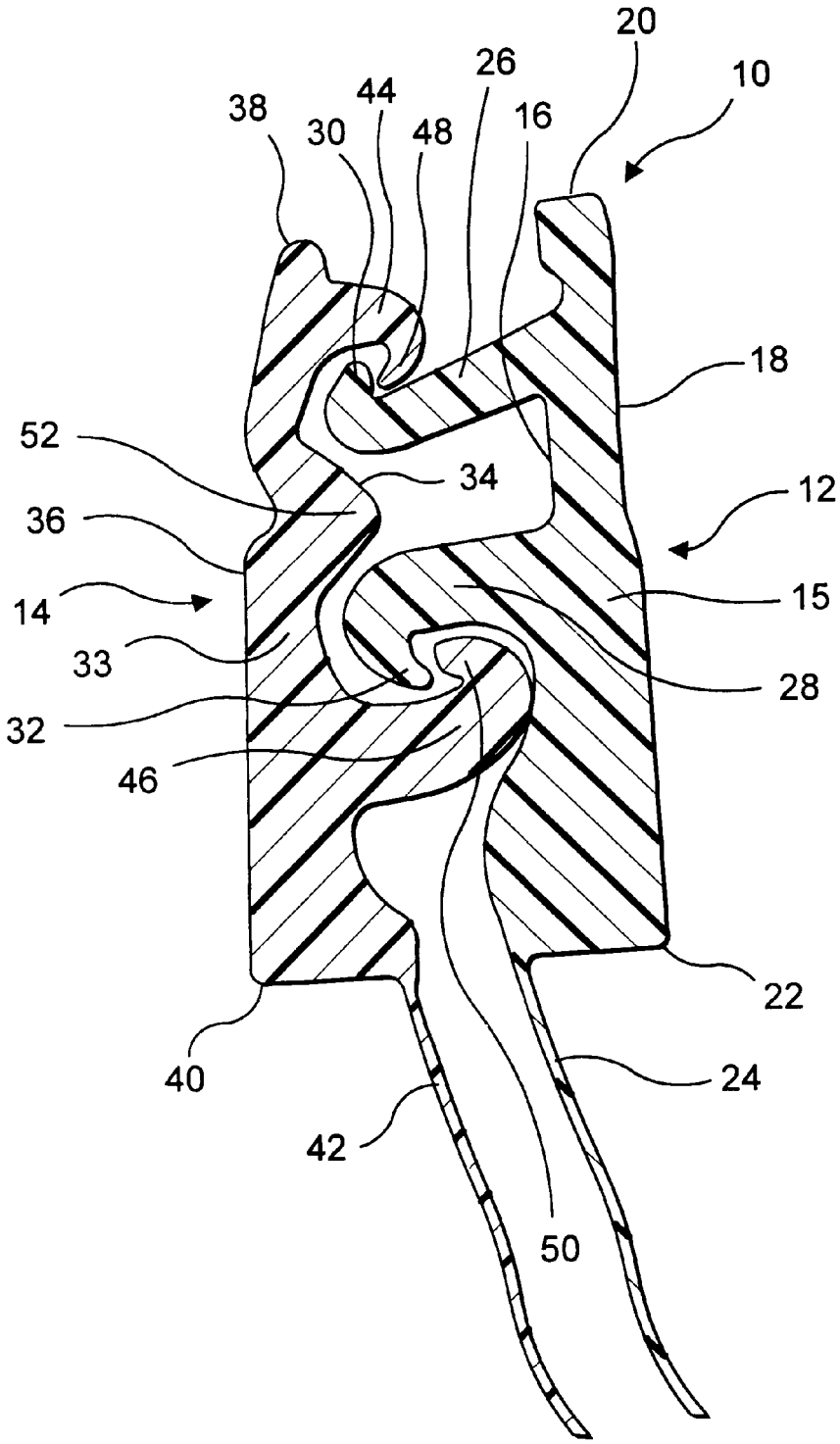
FIG. 1 is a cross sectional view of an interlockable zipper in accordance with the present invention.
Figure 2:
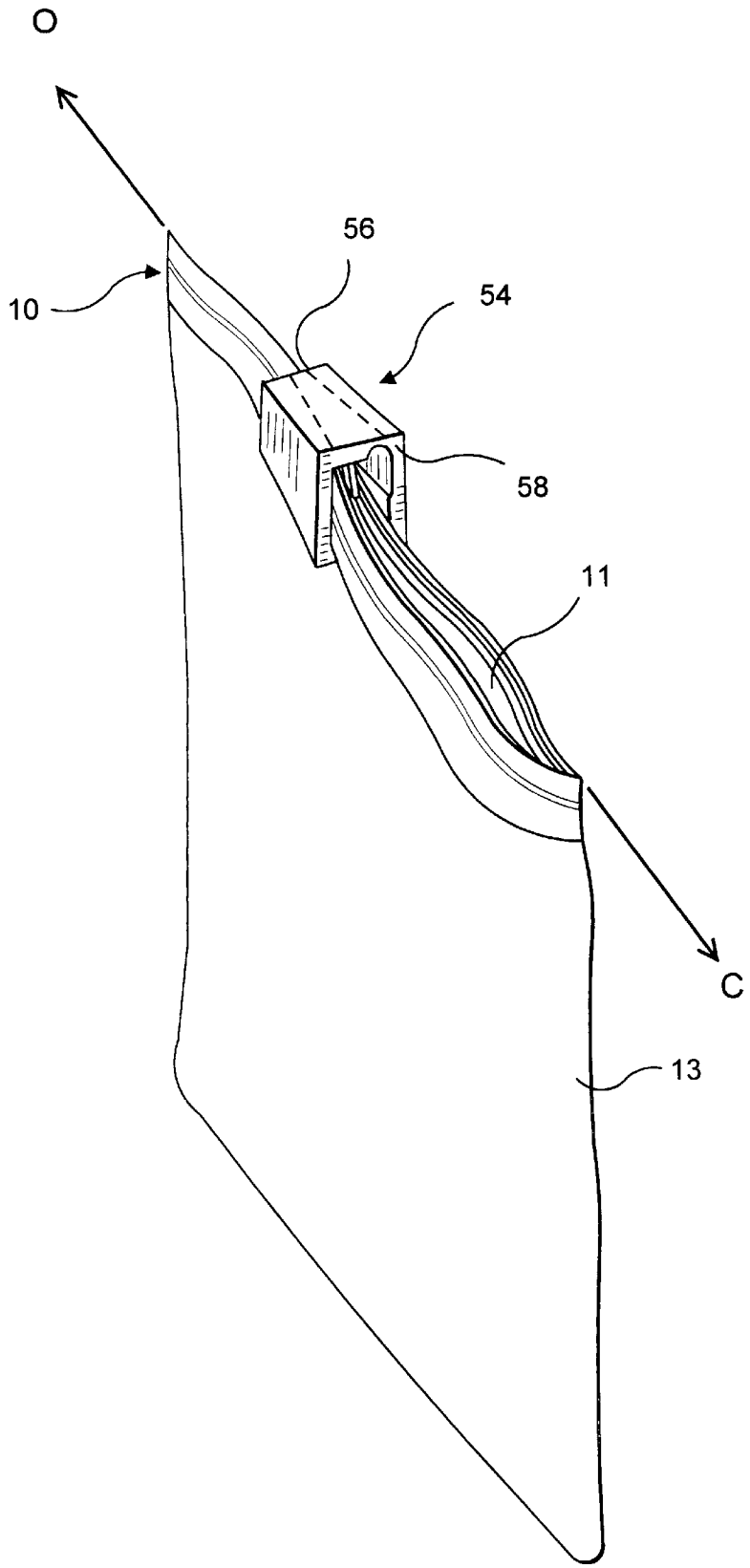
FIG. 2 is a perspective view of the slide zipper assembly in accordance with the present invention attached to a plastic bag.

FIG. 1 shows a cross sectional view of interlockable zipper 10. The zipper 10 is formed of a resilient plastic material such as polyethylene and comprises a first profile 12 and a second profile 14. The zipper 10 is disposable across the mouth 11 of a plastic bag 13, as shown in FIG. 2. For purposes of this description the bag 13 will be assumed to be oriented with its mouth 11 on top as depicted in FIG. 2.

The first profile 12 has a base 15 having an inner side 16 and outer side 18, a top portion 20, a bottom surface 22, a flange 24, a top hooked arm 26 and a bottom hooked arm 28.

The top hooked arm 26 and the bottom hooked arm 28 of the first profile 12 have hooked ends 30 and 32 which are directed away from each other. Thus, the hooked end 30 of top hooked arm 26 is oriented upwardly while the hooked end 32 of the bottom hooked arm 28 is oriented downwardly. As is clear from FIG. 1, the top hooked arm 26 is longer and thinner than the bottom hooked arm 28. The top hooked arm 26 is thus more flexible than the bottom hooked arm 28, thereby providing for ease of opening of the zipper 10 from the outside of a bag employing the zipper 10. Conversely, because bottom hooked arm 28 is shorter and thicker than top hooked arm 26, and thus less flexible, the internal opening force will be greater.

The second profile 14 likewise has a base 33 having an inner side 34 and an outer side 36, a top portion 38, a bottom surface 40, a flange 42, a top hooked arm 44 and a bottom hooked arm 46. The top hooked arm 44 and bottom hooked arm 46 of the second profile 14 have hooked ends 48 and 50 which are directed towards each other and positioned and sized to engage the hooked ends 30, 32 of the first profile hooked arms. Thus, the top hooked arm 44 has a downwardly oriented hooked end 48 which is engageable with the hooked end 30 of the top hooked arm 26 of the first profile 12 and the bottom hooked arm 46 has an upwardly oriented hooked end 50 which is engageable with the hooked end 32 of the bottom hooked arm 28 of the first profile 12. This two-arm configuration of the zipper 10 provides a relatively leak proof seal. The second profile 14 may also have an inwardly directed wedge or bump 52 which is located between the top hooked arm 44 and the bottom hooked arm 46 and aids in guiding the profiles into and out of engagement. The profile flanges 24, 42 provide a means by which the zipper may be guided in an automated bag making process, such as on a form-fill-seal machine.

Figure 3:
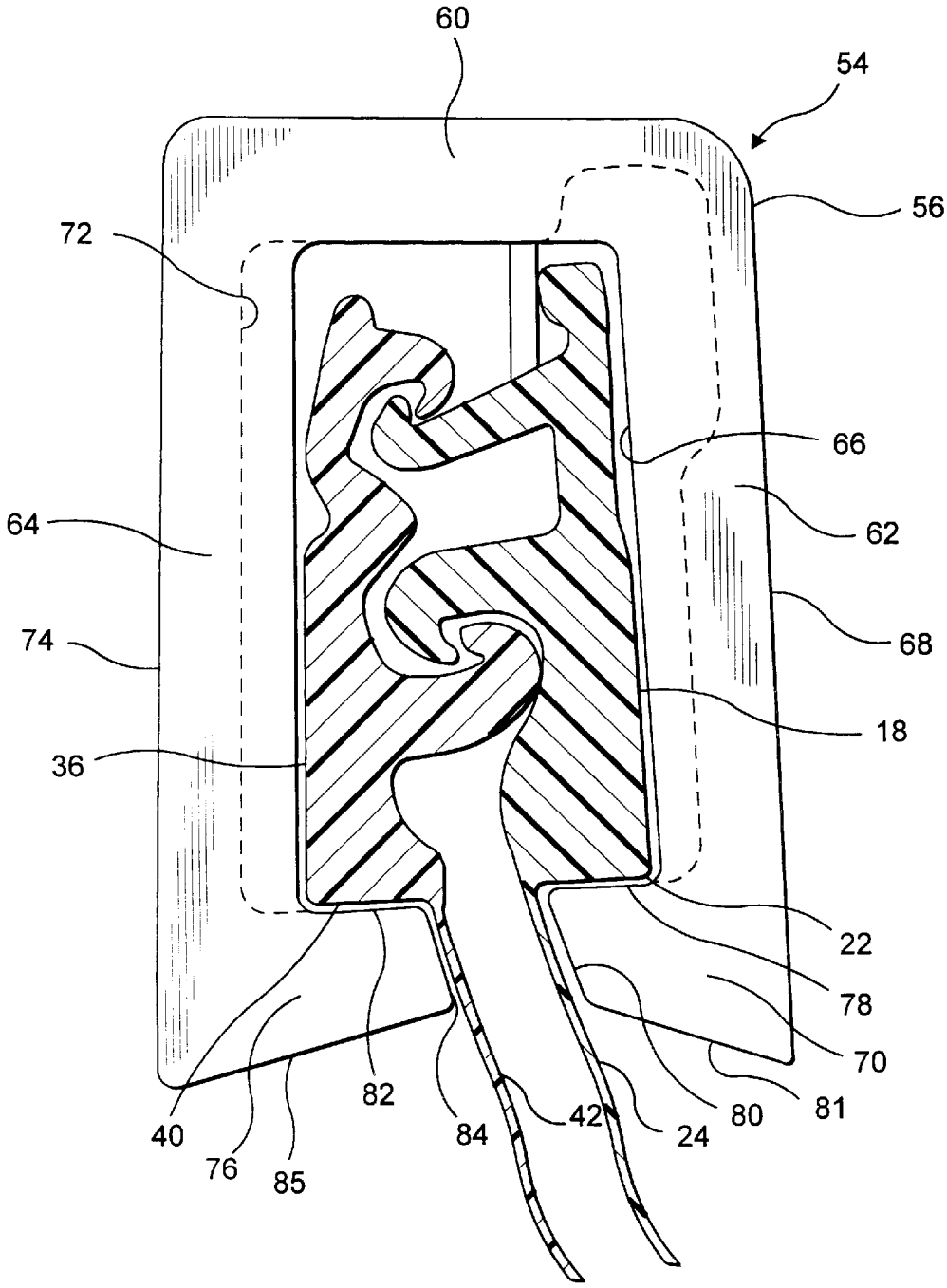
FIG. 3 is a cross sectional view of the closing end of the slider and zipper.
Figure 4:
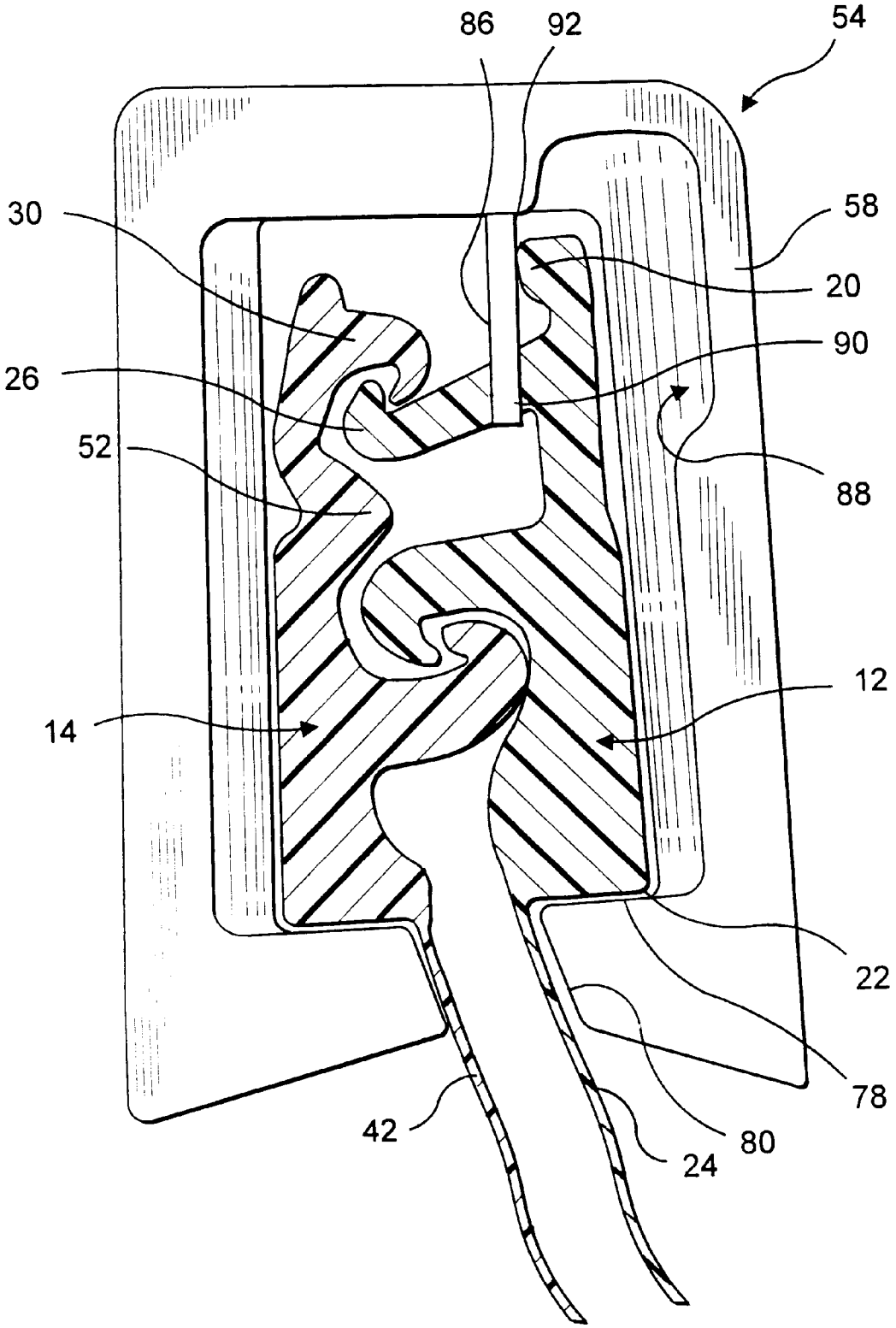
FIG. 4 is a cross sectional view of the opening end of the slider and zipper.

The slide zipper assembly is further provided with a slider 54 which slides along the mouth 11 of the bag 13 as shown in FIG. 2. FIGS. 3 and 4 show how the zipper 10 cooperates with the slider 54. Thus, the slider 54 has a closing end 56 and an opening end 58. As shown in FIG. 2, the slider 54 is slidable in an opening direction "O" in which the zipper profiles 12, 14 are disengaged by the slider, and a closing direction "C" in which the zipper profiles 12, 14 are engaged by the slider.

FIG. 3 shows the details of the closing end of the slider and FIG. 4 shows the details of the opening end of the slider. It should be understood that for purposes of clarity the zipper 10 and slider 54 in FIGS. 3 and 4 are shown with the same orientation. However, when one actually looks at the zipper from the closing end and the opening end the orientations of the zipper and slider will be reversed.

The slider 54 straddles the zipper 10 and is slidable along the zipper 10 in the closing and opening directions. The profiles are closed and sealed to each other at both ends to ensure that the zipper 10 does not become separated at its ends during use. In addition, the zipper 10 may be provided with a stopper at both ends which serves to prevent the slider from becoming disengaged from the zipper.

The slider 54 has a top portion 60, a first arm 62 and a second arm 64. The first arm 62 has an inner side 66, an outer side 68, and an inwardly directed bottom tab 70. Likewise, second arm 64 has an inner side 72, an outer side 74, and an inwardly directed bottom tab 76. The inner sides 66, 72 of the slider arms are tapered towards the closing end 56 so that at the closing end the arms are sufficiently close to press the profiles into engagement with each other.

The tab 70 of the first arm 62 has a tapered top surface 78, a side surface 80, and a tapered bottom surface 81. The tapered top surface 78 of the tab 70 mates with the bottom surface 22 of the first profile 12, imparting a generally upward force thereto. This force, as discussed below, plays a role in the opening and closing action of the slider 54.

The tab 76 of the second arm 64 likewise has a tapered top surface 82, a side surface 84, and a tapered bottom surface 85. The tapered top surface 82 mates with the bottom surface 40 of the second slider arm 64.

The mating of the profile bottom surfaces 22, 40 and the slider tab tapered top surfaces 78, 82 ensures that the slider 54 is securely positioned over the zipper 10 and reduces the possibility that the slider 54 will be pulled off the zipper 10. The slider tab tapered bottom surfaces 81, 85 facilitate insertion of the slider 54 over the zipper 10.

As is clear from FIG. 3, the zipper 10 is captured between the inner sides 66, 72 of the slider arms 62, 64 and between the two tabs 70, 76. The tabs 70, 76 cooperate with the slider top 60 to hold the slider 54 in place. The inner sides 66, 72 of the slider arms 62, 64 are sufficiently close at the closing end so that when the slider 54 is moved in the closing direction "C", the inner sides 66, 72 of the slider arms 62, 64 press against the outer sides 18, 36 of the first and second profiles 12, 14, thereby effecting engagement of the profiles 12, 14.

FIG. 4 shows the opening end 58 of the slider 54. At the opening end 58 the inner sides 66, 72 of the slider arms 62, 64 are sufficiently far apart so as to not impart a closing force to the profiles 12, 14. To this end, at the opening end 58 a separator blade 86 extends downwardly from the slider top as shown. In addition, the inner side 66 of first slider arm 62 is contoured to define a cavity 88 which extends upwardly into the top 60. The separator blade 86 is positioned so that when the slider 54 is moved in the opening direction, the separator blade 86 will deflect the top hooked arm 26 of the first profile 12 downwardly and out of engagement with the top hooked arm 30 of the second profile 14. A component of the force on the top hooked arm 26 of the first profile 12 will also direct the now disengaged profile 12 sideways and into cavity 88.

As the slider 54 is moved in the opening direction "O", the separator blade 86 deflects the top hooked arm 26 of the first profile 12 downwardly and out of engagement with the top hooked arm 30 of the second profile 14 until the top hooked arm 26 engages bump 52. The bump 52 provides a camming surface for the top hooked arm 26 as a component of the force exerted by the separator blade acts on the top hooked arm 26 to urge the first profile 12 away from the second profile 14. Simultaneously, the top surface 78 of the tab 70 pushes the bottom portion 22 of the first profile 12 upwardly. This upward deflection in combination with the outward deflection of the first profile 12 by the separator blade 86 disengages the bottom hooked arm 28 of the first profile 12 from the bottom hooked arm 46 of the second profile 14 and moves the first profile 12 up and into the cavity 88. Alternatively, means could be provided to force the second profile downwardly out of engagement with the first profile, as opposed to forcing the first profile upwardly.

Thus, the combined action of the separator blade 86 and first slider arm tab 70 on the first profile 12 serves to open the zipper as the slider is moved in the opening direction. Movement of the slider in the closing direction causes the slider arms to force the profiles into engagement.

Modifications to the above would be obvious to those of ordinary skill in the art, but would not bring the invention so modified beyond the scope of the appended claims.

We claim:

1. A slide zipper assembly comprising:

an interlocking zipper having a first profile and a second profile;

said first profile including a base having a hooked arm extending from said base toward said second profile;

said second profile including a base having a hooked arm extending from said base toward said first profile, said profile hooked arms being engaged when said zipper is in a closed position;

a slider disposed for movement along said zipper, said slider including a top portion and first and second arms depending from said top portion, said first and second arms depending from said top portion, said first and second arms respectively disposed adjacent said first and second profiles;

said first slider arm including an inwardly directed tab having a tapered surface disposed to engage a portion of said first profile and vertically shift said first profile hooked arm out of engagement with said second profile hooked arm as said slider is moved along said zipper in an opening direction.

2. A slide zipper assembly in accordance with claim 1 wherein said first slider arm inwardly directed tab is tapered to lift said first profile so as to move said first profile hooked arm out of engagement with said second profile hooked arm.

3. A slide zipper assembly in accordance with claim 2 wherein said slider top portion is contoured to define a cavity to receive said lifted first profile.

* * * * *